US008676279B2

(12) United States Patent
McCurdy

(10) Patent No.: US 8,676,279 B2
(45) Date of Patent: Mar. 18, 2014

(54) ELECTRONIC INSTRUMENT ATTACHED TO A HAND

(76) Inventor: Andy McCurdy, Bonita Springs, FL (US)

( * ) Notice: Subject to any disclaimer, the term of this patent is extended or adjusted under 35 U.S.C. 154(b) by 353 days.

(21) Appl. No.: 13/135,287

(22) Filed: Jul. 1, 2011

(65) Prior Publication Data

US 2013/0005412 A1 Jan. 3, 2013

(51) Int. Cl.
*H04W 92/08* (2009.01)

(52) U.S. Cl.
USPC ..... 455/575.6

(58) Field of Classification Search
USPC ..... 455/575.1, 575.6, 575.8; 294/25, 137, 294/142; 361/814; D14/137, 138 R; 150/154, 156; 224/217, 218, 930; 206/320
See application file for complete search history.

(56) References Cited

U.S. PATENT DOCUMENTS

| | | | | |
|---|---|---|---|---|
| 2003/0157958 | A1* | 8/2003 | Bamber | 455/550 |
| 2004/0013279 | A1* | 1/2004 | Takeda | 381/312 |
| 2009/0090750 | A1* | 4/2009 | Alcenat | 224/101 |
| 2010/0116387 | A1* | 5/2010 | Channey et al. | 150/165 |
| 2010/0203924 | A1* | 8/2010 | Hirota | 455/566 |
| 2010/0222118 | A1* | 9/2010 | Interdanato | 455/575.6 |
| 2010/0227655 | A1* | 9/2010 | Takabayashi | 455/575.3 |
| 2010/0264182 | A1* | 10/2010 | Perlman et al. | 224/409 |
| 2011/0034221 | A1* | 2/2011 | Hung et al. | 455/575.8 |
| 2011/0065480 | A1* | 3/2011 | Kim et al. | 455/566 |
| 2011/0266316 | A1* | 11/2011 | Ghalib et al. | 224/217 |
| 2012/0299318 | A1* | 11/2012 | Murphy et al. | 294/25 |

* cited by examiner

*Primary Examiner* — Melody Mehrpour
(74) *Attorney, Agent, or Firm* — The Livingston Firm; Edward M. Livingston, Esq.; Bryan L. Loeffler, Esq.

(57) ABSTRACT

A system for attaching an electronic instrument to the inside of a hand. The system includes a fixed plate removably attached to an electronic instrument. The system further consists of a fixed plate attached to the cell phone and a rotational plate attached to the fixed plate. The rotational plate has threaded there through an elastic band having loops, each of which will connect to a middle finger and a ring finger, respectively, designed to hold the hand of a user snugly on the electronic instrument. The fixed plate may also be attached to a case of a cell phone.

8 Claims, 3 Drawing Sheets

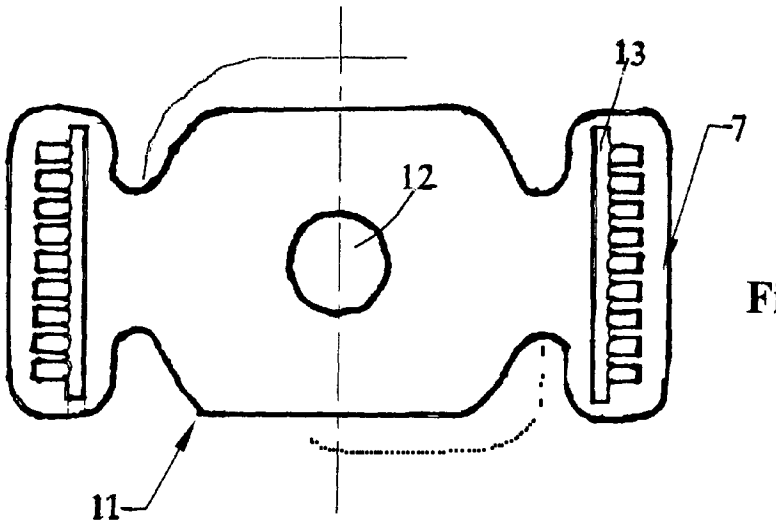
Fig. 3
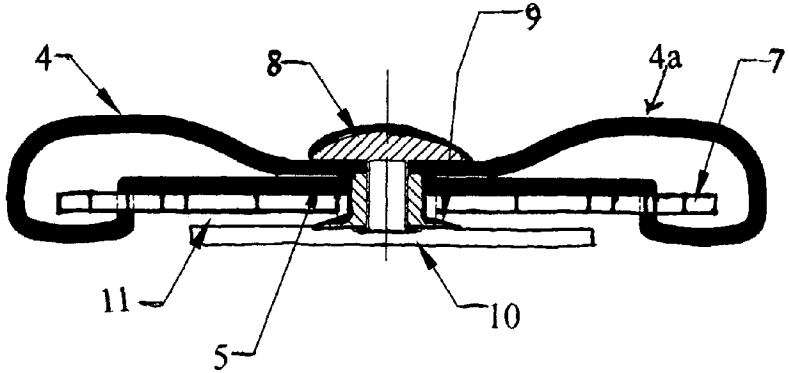
Fig, 2

ELECTRONIC INSTRUMENT ATTACHED TO A HAND

BACKGROUND OF THE INVENTION

Cell phones and various other instruments are in great use in various areas and countries. When the phone is used to answer a call or to send a message, it is hand held and it is difficult to hold the cell phone in certain desirable positions. It is usually held in one hand with the fingers straddling the front of the instrument. Most of the time the thumb of the user does the texting by manipulating the various keys. It often happens that various keys are manipulated by error depending how the cell phone is held. Many times the phone is dropped causing damage.

BRIEF DESCRIPTION OF THE INVENTION

The inventive concept of the invention involves a system whereby the cell phone is permanently held on the inside of the hand by elastic straps that capture the middle finger and the ring finger. Elastic straps are used because there are many different hand sizes and fingers but no matter of the different hand and finger sizes, the cell phone will stay snug on the hand. In addition it is desirable that the instrument will remain rotational relative to the mounting plate of the straps and thereby relative to the hand that is holding the cell phone. It is also desirable that the cell phone can easily be removed from the location of the mounting for maintenance and service reasons.

BRIEF DESCRIPTION OF THE DRAWINGS

FIG. 2 shows the mounting system to be attached to a cell phone;

FIG. 3 is a mounting plate that can rotate relative the mounting system;

DETAILED DESCRIPTION OF THE INVENTION

Figure 1:
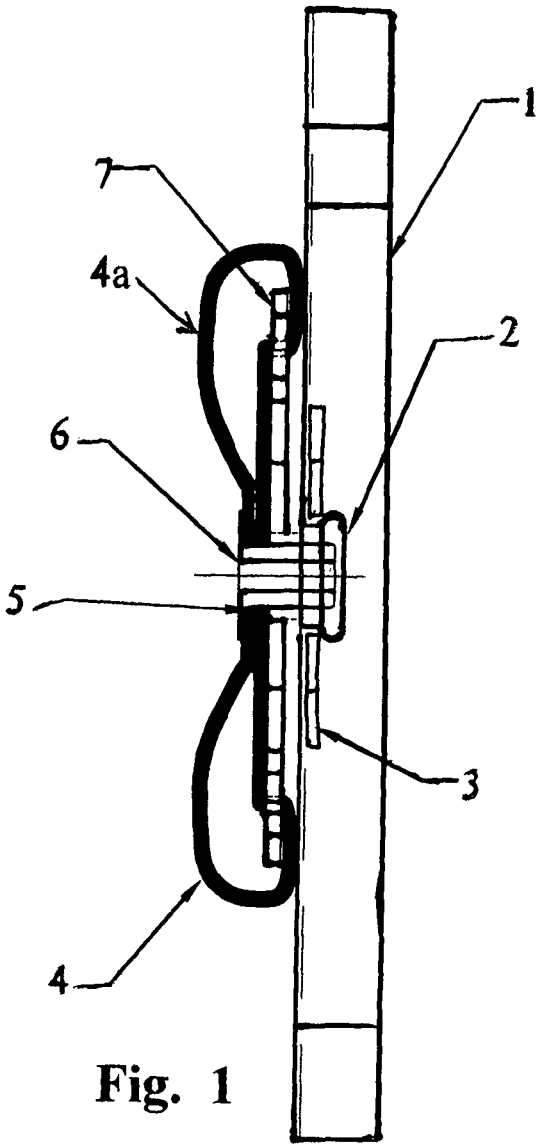
FIG. 1 illustrates the mounting of a cell phone in a casing.

FIG. 1 illustrates the basic system wherein a cell phone case 1 that normally receives the cell phone (not shown). In the middle of the case 1 there is located a socket fastener 2 that will attach the hand attaching system to the inside of a hand (not shown). The hand attaching system includes a fixed plate which is located on the inside or the bottom of the casing 1. On the outside of the casing 1 and on its outside wall there is located a rotating plate 7 which is rotational around the stud fastener 5. The rotational plate has various openings or slots (explained in FIG. 3). The slots receive an elastic band 4 which is threaded into the rotational plate in such a way to create the loops 4 and 4*a*. The purpose of the loops 4 and 4*a* is to receive the middle finger and the ring finger so that the phone case 1 including the cell phone fastened therein will be located on the inside of the hand. Once the elastic band is threaded into the rotational plate 7, the loose ends will be fastened to each other in the vicinity and around the stud fastener by way of an adhesive 5. The rotational plate 7 and the elastic band 4 and 4*a* will finally be held in place by the stud fastener 6 which will be fastened over the socket fastener 2.

FIG. 2 is side view which is similar to the system explained with reference to FIG. 1 except that this system does not include the cell phone case of FIG. 1. In this example, the rotational plate 7 is mounted to a fixed plate 11 which is fastened to the back wall of the call phone by way of a double sided adhesive tape. At 9 is shown the stud which penetrates through the back of the fixed plate which will receive the locking cap 8 on the other side. The stud will receive the rotational plate 7 which has threaded thereon the elastic band to thereby create the finger receiving loops 4 and 4*a*. In this FIG. 2 one can easily see the threading arrangement of the continuous elastic band wherein the loose ends are captured under the and captured under the locking cap 8.

FIG. 3 illustrates a top view of the rotational plate 7 having a central opening therein which will receive the stud 9. Also on the bottom of the rotational plate one can see the fixed plate 11 which is mounted to the back wall of the cell phone by way of a double adhesive tape as was explained in FIG. 2. The rotational plate has lateral slots 7 therein which serve the purpose of threading the elastic band there through.

Figure 5:
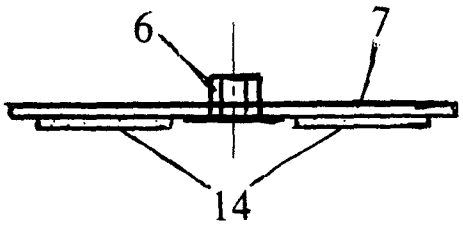
FIG. 5 shows a side view of the bottom plate of FIG. 4.
Figure 4:
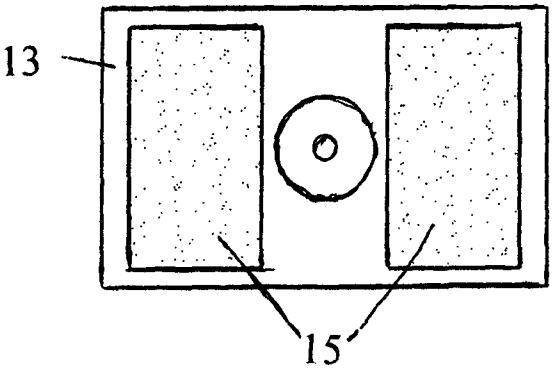
FIG. 4 illustrates a bottom view of a mounting plate.

FIG. 4 shows the bottom of the fixed plate 13 and a different way of fastening the same to the back wall of the cell phone or any other electronic instrument. The bottom of the fixed plate 13 has attached thereon one part of a VELCRO fastener in this case the female part, or the loop part In FIG. 5 there is shown a side view of the fixed plate 13 having the other part of the VELCRO fastener attached thereto, in this case the male part, or the hook part. At 6 is shown the fastening stud 6 which captures the rotating plate and the elastic band threaded there through.

What I claim is:

1. A system for attaching an electronic instrument to a hand of a user, said system includes a fixed plate, means for attaching a rotational plate on one side thereof to said fixed plate, means for attaching said fixed plate on one side thereof to a back wall of a cell phone, means for attaching said rotational plate on another side thereof to a middle finger and a ring finger to said hand so that said cell phone is attached to an inside of said hand; wherein said means for attaching said rotational plate to said middle finger and said ring finger is a band which is threaded through lateral slots located at opposing ends of said rotational plate and secured to a central portion of said rotational plate to create a first loop for said middle finger and a second loop for said ring finger.

2. The system of claim 1, wherein said fixed plate is attached to an inside of a cell phone case.

3. The system of claim 1, wherein said means for attaching said fixed plate to a back wall of said electronic instrument is a double sided adhesive.

4. The system of claim 1, wherein said means for attaching said fixed plate to a back wall of said electronic instrument is a hook and loop system.

5. The system of claim 1, wherein said means for attaching said rotational plate to said fixed plate is a stud fastened to said fixed plate.

6. The system of claim 1, wherein said band is an elastic band.

7. A system for attaching an electronic instrument to a hand of a user, said system includes a fixed plate, means for attaching a rotational plate on one side thereof to said fixed plate, means for attaching said fixed plate on one side thereof to a back wall of a cell phone, means for attaching said rotational plate on another side thereof to a middle finger and a ring finger to said hand so that said cell phone is attached to an inside of said hand; wherein said means for attaching said rotational plate to said middle finger and said ring finger is a band which is threaded through lateral slots located at opposing ends of said rotational plate and secured to a central portion of said rotational plate to create a first loop for said middle finger and a second loop for said ring finger; and said means for attaching said rotational plate to said fixed plate is a stud fastener.

8. A system for attaching an electronic instrument to a hand of a user, said system includes a fixed plate, means for attaching a rotational plate on one side thereof to said fixed plate, means for attaching said fixed plate on one side thereof to a back wall of a cell phone, means for attaching said rotational plate on another side thereof to a middle finger and a ring finger to said hand so that said cell phone is attached to an inside of said hand; wherein said means for attaching said rotational plate to said middle finger and said ring finger is a band which is threaded through lateral slots located at opposing ends of said rotational plate and secured to a central portion of said rotational plate to create a first loop for said middle finger and a second loop for said ring finger; said means for attaching said rotational plate to said fixed plate is a stud fastener; said rotational plate is parallel to said fixed plate; and said rotational plate and fixed plate are parallel to said electronic device so said rotational plate rotates on a plane that is parallel to said fixed plate and electronic device.

* * * * *